US006210150B1

(12) United States Patent
Rosén et al.

(10) Patent No.: US 6,210,150 B1
(45) Date of Patent: Apr. 3, 2001

(54) METHOD AND AN APPARATUS OF OPERATING A BOILER FIRED WITH LIQUID OR GASEOUS HYDROCARBONS

(75) Inventors: Per Rosén, Lund; Jan Wettergard, Sollentuna, both of (SE)

(73) Assignee: Munters Euroform GmbH, Aachen (DE)

( * ) Notice: Subject to any disclaimer, the term of this patent is extended or adjusted under 35 U.S.C. 154(b) by 0 days.

(21) Appl. No.: 09/168,007

(22) Filed: Oct. 7, 1998

(30) Foreign Application Priority Data

Oct. 10, 1997 (DE) ..... 197 44 867

(51) Int. Cl.[7] ..... F23J 7/00

(52) U.S. Cl. ..... 431/4; 431/11; 431/8; 431/211; 261/18.2

(58) Field of Search ..... 431/4, 8, 11, 210, 431/211, 207; 126/59.5; 60/39.05; 48/94, 110, 105; 261/18.2

(56) References Cited

U.S. PATENT DOCUMENTS 3,183,864 * 5/1965 Stengel ..... 431/4
3,938,934 * 2/1976 Frondorf ..... 431/11
4,009,984 * 3/1977 Morrison ..... 431/4
4,089,633 * 5/1978 Barghout et al. ..... 431/4
4,162,140 * 7/1979 Reed ..... 431/284
4,173,450 * 11/1979 Schrank ..... 431/4
4,394,118 * 7/1983 Martin ..... 431/4
4,533,314 * 8/1985 Herberling ..... 431/4
5,620,503 * 4/1997 Miller et al. .
5,832,846 * 11/1998 Mankowski et al. ..... 431/4

FOREIGN PATENT DOCUMENTS 15 207 * 9/1881 (DE) .
0 251 196 * 1/1988 (EP) .
2 555 711 * 5/1985 (FR) .

* cited by examiner

*Primary Examiner*—Ira S. Lazarus
*Assistant Examiner*—Josiah C. Cocks
(74) *Attorney, Agent, or Firm*—Herbert Dubno

(57) ABSTRACT

A method and an apparatus of operating a boiler fired with liquid or gaseous hydrocarbons are described. Fuel and atomizing air are supplied to the burner of the boiler wherein the atomizing air is subjected to a moistening process prior to mixing with the fuel. Heated water is vaporized and is contacted with the atomizing air. The generated water vapor together with the atomizing air is supplied to the burner. In this manner, the portion of the $NO_x$ emissions in the flue gas of the boiler can be reduced.

3 Claims, 1 Drawing Sheet

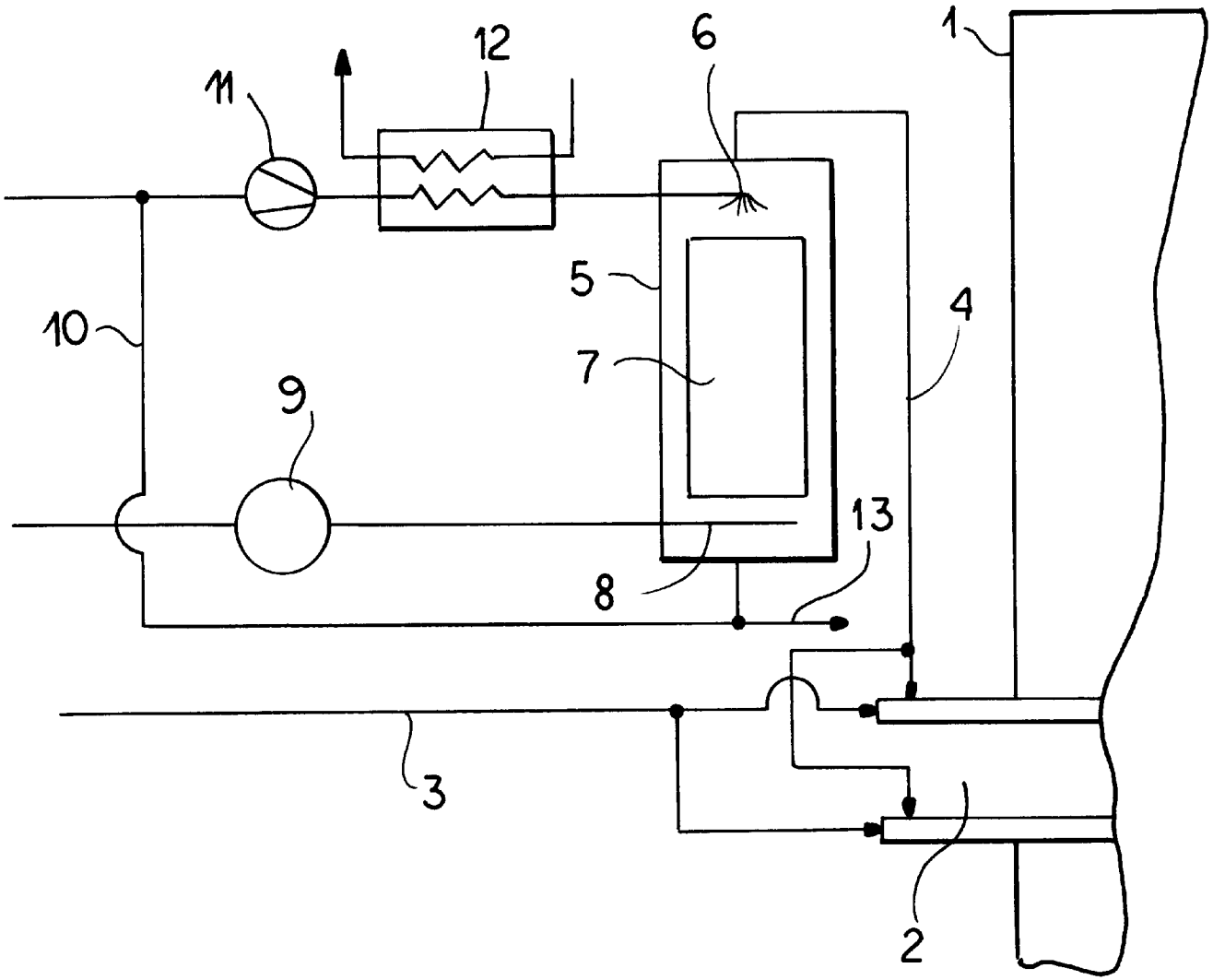
1
2
3
4
5
6
7
8
9
10
11
12
13

METHOD AND AN APPARATUS OF OPERATING A BOILER FIRED WITH LIQUID OR GASEOUS HYDROCARBONS

FIELD OF THE INVENTION

The present invention is directed to a method of operating a boiler fired with liquid or gaseous hydrocarbons, especially heating fuel oil or natural gas, according to which fuel and atomizing air are supplied to the burner of the boiler and the generated fuel-air mixture is burned. Furthermore, the invention is directed to an apparatus for carrying out such a method.

BACKGROUND OF THE INVENTION

Today, modern heating boilers are fired with heating fuel oil or natural gas. When burning the hydrocarbons forming these fuels, flue gases are generated which contain certain undesired components resulting in detrimental contamination of the atmospheric air. The nitrogen oxides or nitric oxides ($NO_x$) are an especially detrimental component. A not unessential part of these $NO_x$ emissions is generated by the flue gases of heating boilers fired with hydrocarbons.

$NO_x$ is detrimental since it contributes to the generation of the photochemical smog in a complicated manner. By this, the ozone concentration near to the ground can be increased. Furthermore, $NO_x$ results in an overacidification of the ground and of water. Moreover, it represents a health risk especially for asthmatics.

OBJECT OF THE INVENTION

The object of the invention is to provide a method and an apparatus for operating a boiler fired with liquid or gaseous hydrocarbons with which the $NO_x$ portion in the flue gases of the boiler can be reduced.

SUMMARY OF THE INVENTION

According to the invention, method of the above-described kind according to which the atomizing air is subjected to a moistening process prior to mixing with the fuel.

With the inventive solution one succeeds in further reducing the $NO_x$ emissions in the flue gas of the boiler. Furthermore, the concentration of additional detrimental substances in the flue gas can be reduced. The energy consumption for the operation of the boiler can be reduced, too. $NO_x$ is generated at high temperatures (more than 1300° C.) wherein the concentration thereof increases exponentially with increasing temperatures. Moreover, for the formation of $NO_x$ a certain time and excess oxygen are necessary. Dependent on the actual conditions during the combustion different fractions of nitrogen oxides are formed. The high temperature peaks are compensated by the added moist air. Furthermore, with regard to the whole combustion air, the proportion of nitrogen is reduced and the excess of oxygen is somewhat decreased since the generated water vapor does not contain any free oxygen in contrast to air.

Water or water vapor are used as preferred substances for the moistening process.

It is an essential aspect of the invention that the atomizing air for the fuel is subjected to the moistening process. By this, the liquid vapor portion generated by the moistening is mixed intimately with the fuel particles so that the desired effect occurs. Accordingly, the supplied liquid vapor is directly supplied to the core of the combustion whereby the desired combustion conditions are obtained which result in a reduction of the $NO_x$ gases.

According to the inventive method, the atomizing air can be directly mixed with liquid vapor, especially water vapor, or the atomizing air is contacted with a for moistening wherein preferably the contacted liquid is carried along with the atomizing air as a liquid/vapor portion.

The moistening agent (preferably water) is practically heated prior to the contact with the atomizing air in order to enable the corresponding formation of liquid vapor or to simplify the same. It is only necessary to slightly heat the liquid since, through the contact with the possibly compressed atomizing air, large amounts of liquid are vaporized and thus the characteristics of the atomizing air can be substantially changed. One succeeds in reaching or maintaining a low temperature of the atomizing air which has a favorable effect for the combustion.

As regards the contacting of the liquid with the atomizing air, according to one embodiment of the invention it is proposed to atomize the liquid and to make contact of the formed liquid mist with the atomizing air. Another embodiment of the invention provides that the liquid and the atomizing air are directed over a contact body and are contacted with one another in this manner. Of course, also in this case the liquid can be atomized prior to the application of the contact body. In both cases an intimate mixing results. Of course, when proceeding in this manner at least a part of the liquid evaporates and is carried along with the atomizing air. The remaining part of the liquid can be collected and can be redirected to the liquid circuit.

According to the evaporation of the liquid (of the water) in a gas mixture resulting in this manner, the vaporization occurs at substantially lower temperatures than in the case of the presence of a pure liquid. By the occurrence of the vaporization at a relatively low temperature it is possible to carry out the vaporization process with little energy. Corresponding energy for preheating the liquid is present in large amounts through the heat supplied by the boiler.

Practically, the atomizing air is contacted with the moistening agent in counterflow. So, for instance, the atomizing air is directed from below to above and the moistening agent is directed from above to below. However, it is also possible to direct both media for contacting in crossflow or even in parallel flow. Thus, all directions are suitable.

Practically, the atomizing air is compressed prior to moistening (by means of a compressor or a blower) so that it has been correspondingly heated when contacting the liquid and enables the vaporization of the supplied liquid by heat exchange.

The inventive method is completely self-regulating. The used liquid is distilled by the method. Since the flow rate of the atomizing air increases after the moistening process, the possibility exists to strongly reduce the energy consumption, i.e. more than by the amount necessary for the use of an additional pump for circulating the liquid for the moistening process. In addition to a reduction of the $NO_x$ emissions and of other substances detrimental for the envirionment in the flue gas of the boiler, the energy consumption for the blower or for the compressor of the atomizing air can be reduced.

Furthermore, the invention is directed to an apparatus for carrying out the above-cited method, said apparatus comprising a boiler with a burner and a fuel supply line as well as an atomizing air supply line for the burner. According to the invention, the apparatus is characterized in that a moistening means for the atomizing air is provided in the burner or in the atomizing air supply line.

Preferably, the moistening means is arranged behind a blower or a compressor for the atomizing air in flow direction of the atomizing air. Such a flower or such a compressor is required anyhow for the supply of air for the burner. Generally, the moistening means provided according to the invention can be installed in existing systems without large additional efforts. For this, the moistening means and a liquid circuit have to be integrated into the existing system of conduits. Preferably, the moistening means is a moistening tower.

Particularly, the moistening means itself has a connection for the atomizing air, a connection for the moistening agent and an atomizing means for the moistening agent. When the moistening means is designed as moistening tower, the connection for the moistening agent is situated at the upper end of the tower and the atomizing means is situated in the upper tower region. The connection for the atomizing air is situated at the lower end of the tower. Accordingly, a contact between moistening agent and atomizing air in counterflow is realized wherein the moistening means can additionally contain a contact body onto which the moistening agent is atomized by means of the atomizing means (nozzle). Accordingly, the moistening agent falls down as mist and is collected at the bottom of the moistening tower from which it is redirected from the circuit to the upper end of the tower. Simultaneously, the compressed and heated atomizing air is introduced into the moistening tower from below and flows upwardly wherein it contacts the liquid mist. Preferably, the outlet for the moistened atomizing air is also situated at the upper end of the tower.

Preferably, the apparatus has additionally means for preheating the moistening agent prior to contact with the atomizing air. Practically, this means is a heat exchanger which preferably obtains heat energy by the boiler of the apparatus. The liquid is circulated in a liquid circuit by means of a pump, said circuit containing the pump, the heat exchanger and the moistening tower. Optionally, the liquid collected at the lower end of the moistening tower can be also drained.

Preferably, the liquid itself is water. However, other liquids or liquid mixtures can be also used with which the same or a corresponding purpose can be achieved.

BRIEF DESCRIPTION OF THE DRAWING

In the following the invention is described by means of an example in connection with a single drawing in detail. The drawing shows schematically in its sole FIGURE the structure of an inventive apparatus.

SPECIFIC DESCRIPTION

The representation shows schematically a boiler 1 with a burner 2 which is supplied with fuel, for instance heating fuel oil, through a fuel line 3. Furthermore, the burner 2 has an atomizing air supply line 4. The atomizing air supplied through this line serves for atomizing the fuel for the formation of a fuel-air mixture which is subjected to a combustion process.

Normally, the atomizing air is supplied to the burner by means of a blower shown at 9. According to the inventive embodiment, the atomizing air is introduced into a moistening tower 5 by the blower 9 under pressure and in a heated condition. The introduction is realized at the lower end of the tower. From a corresponding line 8 the atomizing air is blown upwardly. A contact body 7 consisting of a suitable material is situated within the moistening tower 5. A liquid supply line of a liquid circuit shown at 10 opens into the upper end of the tower. The liquid is water. The water is supplied to a heat exchanger 12 by means of the pump 11 and is heated there. The heat energy for heating the water can be provided by the boiler 1. After passing the heat exchanger 12, the heated water enters the moistening tower and is atomized therefrom to the contact body 7 by means of an atomizing means 6 (nozzle). The formed water mist flows downwardly along the contact body 7 and encounters the rising atomizing air. Thereby, the water mist withdraws heat energy from the atomizing air and is vaporized. The atomizing air which is further rising and enriched with water vapor in this manner leaves the moistening tower 5 at the upper end and is supplied to the burner by means of the above-mentioned atomizing air supply line 4.

In the moistening tower 5 the supplied water is only partly vaporized. A larger part is collected in the lower end portion of the moistening tower 5 and is redirected into the liquid circuit 10 therefrom. Alternatively, excess water can be drained, as shown at 13.

What is claimed is:

1. A method of operating a boiler fired with a fuel selected from the group which consists of liquid and gaseous hydrocarbons, heating fuel oil and natural gas, wherein the fuel and atomizing air are supplied to a burner of the boiler to form a fuel-air mixture and the formed fuel-air mixture is burned, and wherein the atomizing air, for reducing an $No_x$, content in the flue gases, is subjected to a moistening process prior to mixing with the fuel according to which the atomizing is contacted with a moistening liquid, said process comprising:

preheating the moistening liquid prior to contact with the atomizing air to form a preheated liquid, introducing the preheated moistening liquid into an upper end of a moistening tower, atomizing the preheated liquid in the upper end of said moistening tower and forming a liquid mist, letting the formed liquid mist flow downwardly along and in contact with a contact body in the moistening tower, contacting at least in part on said contact body, in counter flow the liquid mist with the atomizing air introduced into a lower end of the moistening tower and rising therein and intimately mixing the same, evaporating at least a part of the liquid mist by the contact of said atomizing air therewith to form a vapor, and supplying the atomizing air enriched with the vapor of the liquid mist to the burner of the boiler.

2. The method according to claim 1 wherein the thermal energy generated by the boiler is used for preheating the moistening liquid.

3. The method according to claim 2 wherein the atomizing air is compressed prior to moistening.

* * * * *